US008038827B2

(12) United States Patent
Nowak et al.

(10) Patent No.: US 8,038,827 B2
(45) Date of Patent: Oct. 18, 2011

(54) TEAR TAPE APPLICATOR FOR REAM WRAP AND OTHER PACKAGING MATERIALS

(75) Inventors: Michael R. Nowak, Seymour, WI (US); David W. Schneider, Sheboygan, WI (US)

(73) Assignee: Coating Excellence International LLC, Wrightstown, WI (US)

( * ) Notice: Subject to any disclaimer, the term of this patent is extended or adjusted under 35 U.S.C. 154(b) by 0 days.

(21) Appl. No.: 12/915,359

(22) Filed: Oct. 29, 2010

(65) Prior Publication Data

US 2011/0036057 A1 Feb. 17, 2011

Related U.S. Application Data

(60) Division of application No. 12/022,467, filed on Jan. 30, 2008, now Pat. No. 7,849,904, which is a continuation-in-part of application No. 11/691,158, filed on Mar. 26, 2007, now abandoned, which is a division of application No. 11/077,683, filed on Mar. 11, 2005, now abandoned, which is a continuation-in-part of application No. 10/797,312, filed on Mar. 10, 2004, now abandoned.

(51) Int. Cl.
*B29C 65/50* (2006.01)

(52) U.S. Cl. ..... 156/270; 156/519; 156/552

(58) Field of Classification Search ..... 156/256, 156/270, 324, 361, 519, 552
See application file for complete search history.

(56) References Cited

U.S. PATENT DOCUMENTS

| | | | | |
|---|---|---|---|---|
| 1,994,468 | A | | 3/1935 | Freeman |
| 2,922,342 | A | | 1/1960 | Chalmers et al. |
| 3,278,019 | A | | 10/1966 | Martin et al. |
| 3,345,918 | A | | 10/1967 | Simeone |
| 3,379,364 | A | | 4/1968 | Pilger |
| 3,869,328 | A | | 3/1975 | Instance |
| 4,011,976 | A | | 3/1977 | Greer |
| 4,093,069 | A | | 6/1978 | Smolderen |
| 4,208,932 | A | | 6/1980 | Anderson |
| 4,364,787 | A | * | 12/1982 | Radzins ..... 156/164 |
| 4,498,274 | A | | 2/1985 | Vorhauer |
| 4,523,919 | A | | 6/1985 | Focke et al. |
| 4,702,731 | A | | 10/1987 | Lambrecht et al. |
| 4,765,118 | A | | 8/1988 | Akutsu et al. |
| 4,773,541 | A | | 9/1988 | Riddell |
| 4,795,510 | A | * | 1/1989 | Wittrock et al. ..... 156/64 |
| 4,848,630 | A | | 7/1989 | Niestrath et al. |
| 4,947,994 | A | | 8/1990 | Newsome |
| 5,021,111 | A | * | 6/1991 | Swenson ..... 156/264 |
| 5,026,450 | A | * | 6/1991 | Cucuzza et al. ..... 156/244.11 |

(Continued)

FOREIGN PATENT DOCUMENTS

| | | |
|---|---|---|
| EP | 595722 | 5/1994 |

(Continued)

*Primary Examiner* — Katarzyna Wyrozebski Lee
*Assistant Examiner* — Scott W Dodds
(74) *Attorney, Agent, or Firm* — Duane Morris LLP

(57) ABSTRACT

The present invention relates to a method for applying tear tape to a wrapper by advancing a web by continuous movement in a machine direction. The tear tape is advanced in a cross direction, and cut in order to provide a cut portion of the tear tape. The cut portion of the tear tape is then advanced in the cross direction and into alignment with a width of the web and applied to the web without stopping the web from its continuous movement in the machine direction.

7 Claims, 4 Drawing Sheets

U.S. PATENT DOCUMENTS

| | | | | |
|---|---|---|---|---|
| 5,041,073 | A | 8/1991 | Eicker | |
| 5,203,935 | A | 4/1993 | May et al. | |
| 5,358,757 | A | 10/1994 | Robinette et al. | |
| 5,366,295 | A | 11/1994 | Montesissa et al. | |
| 5,413,656 | A | 5/1995 | Kuhnhold et al. | |
| 5,415,716 | A | 5/1995 | Kendall | |
| 5,489,060 | A | 2/1996 | Godard | |
| 6,557,609 | B1 | 5/2003 | Fini et al. | |
| 6,652,701 | B1 * | 11/2003 | Boulanger | 156/267 |
| 6,722,413 | B1 * | 4/2004 | Koehler et al. | 156/519 |
| 2005/0006265 | A1 | 1/2005 | Anderson et al. | |
| 2006/0027637 | A1 | 2/2006 | Conrad et al. | |

FOREIGN PATENT DOCUMENTS

| | | |
|---|---|---|
| GB | 2206555 | 1/1989 |

* cited by examiner

TEAR TAPE APPLICATOR FOR REAM WRAP AND OTHER PACKAGING MATERIALS

CROSS REFERENCE TO RELATED APPLICATIONS

The present application is a Divisional application of U.S. application Ser. No. 12/022,467, filed Jan. 30, 2008, now U.S. Pat. 7,849,904; which is a Continuation-in-Part application of U.S. application Ser. No. 11/691,158, filed Mar. 26, 2007, now abandoned; which is itself a Divisional of U.S. application Ser. No. 11/077,683, filed Mar. 11, 2005, now abandoned; which is itself a Continuation-in-Part application of U.S. application Ser. No. 10/797,312, filed Mar. 10, 2004, now abandoned.

FIELD OF THE INVENTION

The claimed invention relates generally to equipment for applying tear tape to a packaging substrate, such as ream wrap, paper or film products, or any packaging materials. The claimed invention generally relates to equipment that interfaces and cooperates with rewinding, wrapping, or packaging equipment.

BACKGROUND OF THE INVENTION

Packaging material for reams (i.e., 500 sheets) of cut paper is typically manufactured in large rolls, printed or not printed, and rewound and/or cut to specific sizes. The packaging material is then sold to paper manufacturers who package the reams of paper on wrapping lines. Reams of cut paper (e.g., 8½ inches×11 inches, etc.) for copy machines, computers, printers, and other home and office applications are most commonly packaged for shipping, storage, and retail sale in various packaging materials, including paper, paper/film combinations, and solid single- or multi-layer plastic films. As more people have acquired home computers and printers, the use of copier, printer, and computer papers by individual consumers has increased. Individual consumers typically purchase individually wrapped reams of paper at an office supply store, retail store, or through an office supply catalog.

Small business and home office users often need to use only part of a ream at a time and store the remainder of an open ream. A major disadvantage of traditional ream wrap packaging for the individual user is that the current method of opening the packaging destroys the integrity of the entire wrapped ream because such wrappers lack an easy-open ability. For instance, when the folded bottom or top end of the wrapped ream is torn open, the entire folded package tears and opens, destroying the integrity of the wrapped structure and exposing and scattering the loose sheets of paper remaining in the ream. For the individual user who uses only a portion of the ream at a time and needs to store the remaining sheets, the unbound papers pose an inconvenience and impediment to storage. Since the structural support of the original packaging is compromised, the result for individual users is often physical damage to the unbound sheets of paper being stored for future use.

The current marketplace demands a packaging material that may be opened easily so that a user does not tear or destroy the packaging integrity and may remove part of a ream and store the remaining sheets in a structure that prevents physical damage and scattering of loose papers. When torn, a tear tape or easy-open feature enables one end of the package to open, without tearing the remaining packaging, leaving the remaining structure of the ream wrap intact. The remaining package enables the individual user to both safely and easily store and dispense papers.

Such easy-open packaging is equally applicable to other consumer goods, such as, for example, paper towels, napkins, toilet paper, etc., where a tear tape applied across a web either on the packaging line or during the manufacture of the packaging materials would be advantageous.

U.S. Pat. No. 6,557,609 provides an apparatus for cutting and applying a tearing strip to a packaging film. The apparatus uses a pressing device to which a transverse blade for cutting the tear strip and two (2) auxiliary blades for notching/cutting the edge of the packaging film are integrally fixed. When the tear strip is fed underneath the packaging film and the pressing device is actuated, the following three (3) actions occur simultaneously: (1) tear strip is cut; (2) notches are cut into the edge of the packaging film; and (3) tear strip is adhered to the packaging film. This apparatus requires the belt conveying the tear strip and the packaging film to be stopped or stationary while the tear strip is being applied to the packaging film.

In contrast to the prior art, in embodiments of the claimed invention, the packaging material/web is not stopped when applying the tear strip. In addition, the notching/cutting of the edge of the packaging material is performed before the tear strip is applied and also does not require the packaging material/web to be stopped or stationary. Moreover, embodiments of the invention provide an improved non-contact cutting mechanism, namely a laser, for cutting the tear tape, which improves the prior art. Embodiments of the invention further improve the prior art by resulting in faster application speeds and more accurate and reliable application of tear tapes.

SUMMARY OF THE INVENTION

The present invention relates to a system and method for applying tear tape to a packaging substrate. Features of the system include a tear tape applicator unit comprising a laser/tear tape unwind assembly and a tear tape applicator assembly and a winder comprising an unwind roll and a rewind roll. A packaging substrate is advanced from the unwind roll to the rewind roll. The tear tape applicator unit interfaces the winder such that at least one portion of a tear tape is cut by the laser/tear tape unwind assembly and applied to the web of packaging substrate by the tear tape applicator assembly. Features of the method include advancing a web of a packaging substrate along a web path from an unwind end to a rewind or wind-up end, cutting at least one portion of a tear tape, advancing said at least one portion of said tear tape toward said web path, and applying said at least one portion of said tear tape to said web.

The present invention relates to a packaging material that is opened easily and without tearing so that a user may remove part of a ream of paper and store the remaining sheets in a structure that prevents physical damage and scattering of loose parts. It is an object of the present invention for the ream wrap to be opened easily by at least one tear tape that surrounds the entire width of a wrapped ream, avoiding tearing of the packaging material and destruction of the packaging integrity.

It is an object of the present invention for certain embodiments of the tear tape applicator to interface and cooperate with winder, re-winder, and slitting devices commonly known and used, or later realized and implemented, in the printing and packaging arts.

It is a further object of the present invention for certain embodiments to interface with any winder, re-winder, or slitting device, currently known or later realized, at either the unwind end or the rewind end of a rewinding line.

BRIEF DESCRIPTION OF THE DRAWINGS

These and other features and advantages will be more fully disclosed in, or rendered obvious by, the following detailed description of the preferred embodiments of the invention which are to be considered together with the accompanying drawings wherein like numbers refer to like parts and further wherein.

DETAILED DESCRIPTION OF THE INVENTION

Figure 1:
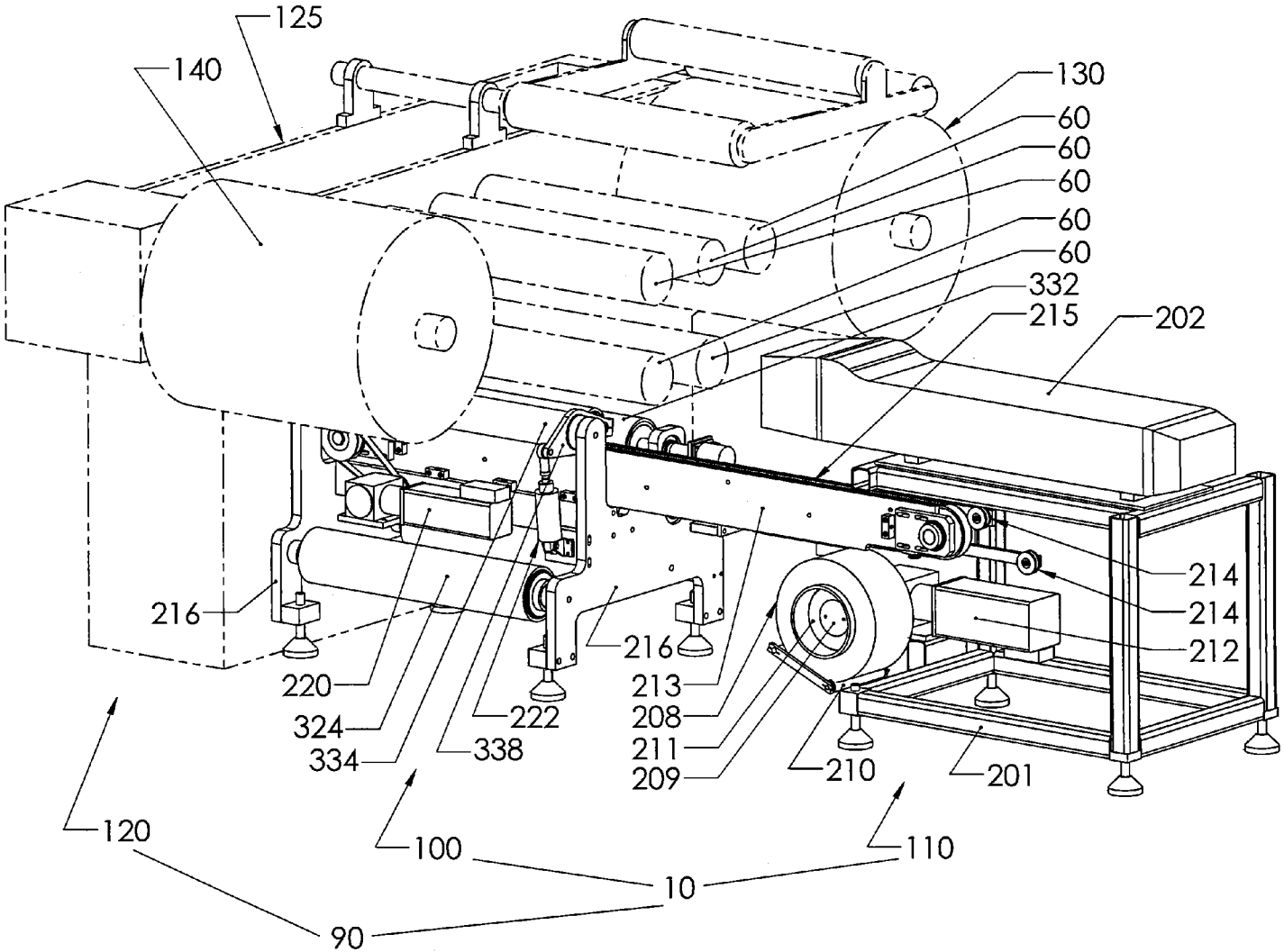
FIG. 1 is an isometric view of a system for applying tear tape in accordance with an embodiment of the invention.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "joined," "connected," and "interconnected," refer to a relationship wherein structures are secured or attached to one another either directly or indirectly through intervening structures, as well as both movable or rigid attachments or relationships, unless expressly described otherwise.

Referring to FIG. 1, an embodiment of the invention includes a system for applying tear tape 90. System 90 generally comprises tear tape applicator unit 10 and winder or re-winder 120. Tear tape applicator unit 10 interfaces and cooperates with winder 120. Tear tape applicator unit 10 comprises tear tape applicator assembly 100 and laser/tear tape unwind assembly 110. Winder 120 generally comprises a base 125, a rewind or wind-up roll 130, idler/dancer rolls 60, and an unwind roll 140. Winder 120 may be any winder, re-winder, or slitting apparatus, such as, for example, a Stanford winder, re-winder, or slitting apparatus. In preferred embodiments, tear tape applicator unit 10 comprises a separate unit from winder 120 that stands alone, is movable and removable, and may be fitted for and attached to a manufacturer's rewinding and/or wrapping equipment. In this way, the manufacturer can apply tear tapes on the web of ream wrap or other packaging material in its own rewinding and/or packaging processes. In some embodiments, more than one tear tape applicator unit 10 cooperates with at least one winder or re-winder 120 such that more than one tear tape can be substantially simultaneously applied to the packaging material or web.

Figure 2:
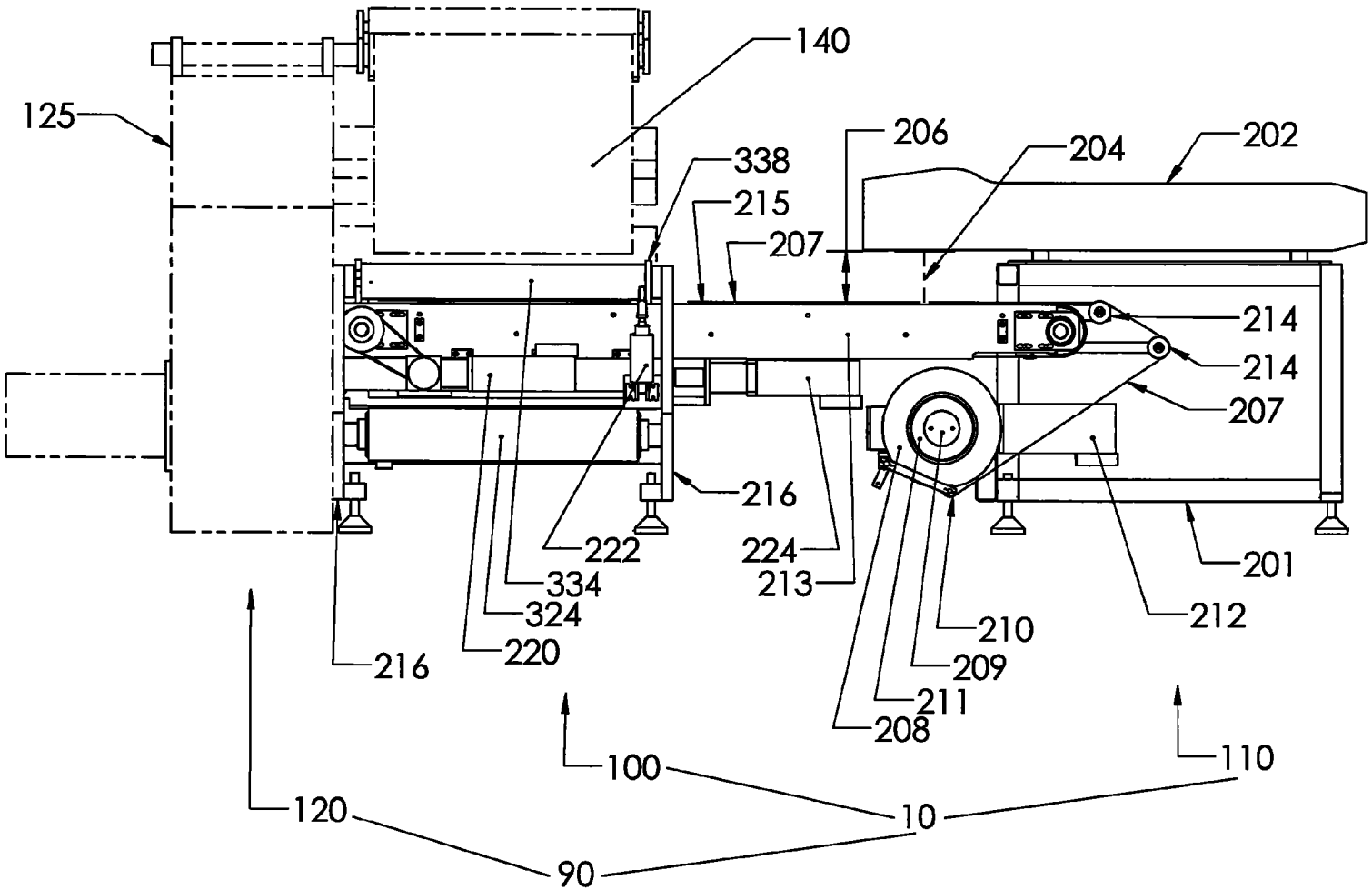
FIG. 2 is a side view of the system of FIG. 1.
Figure 3:
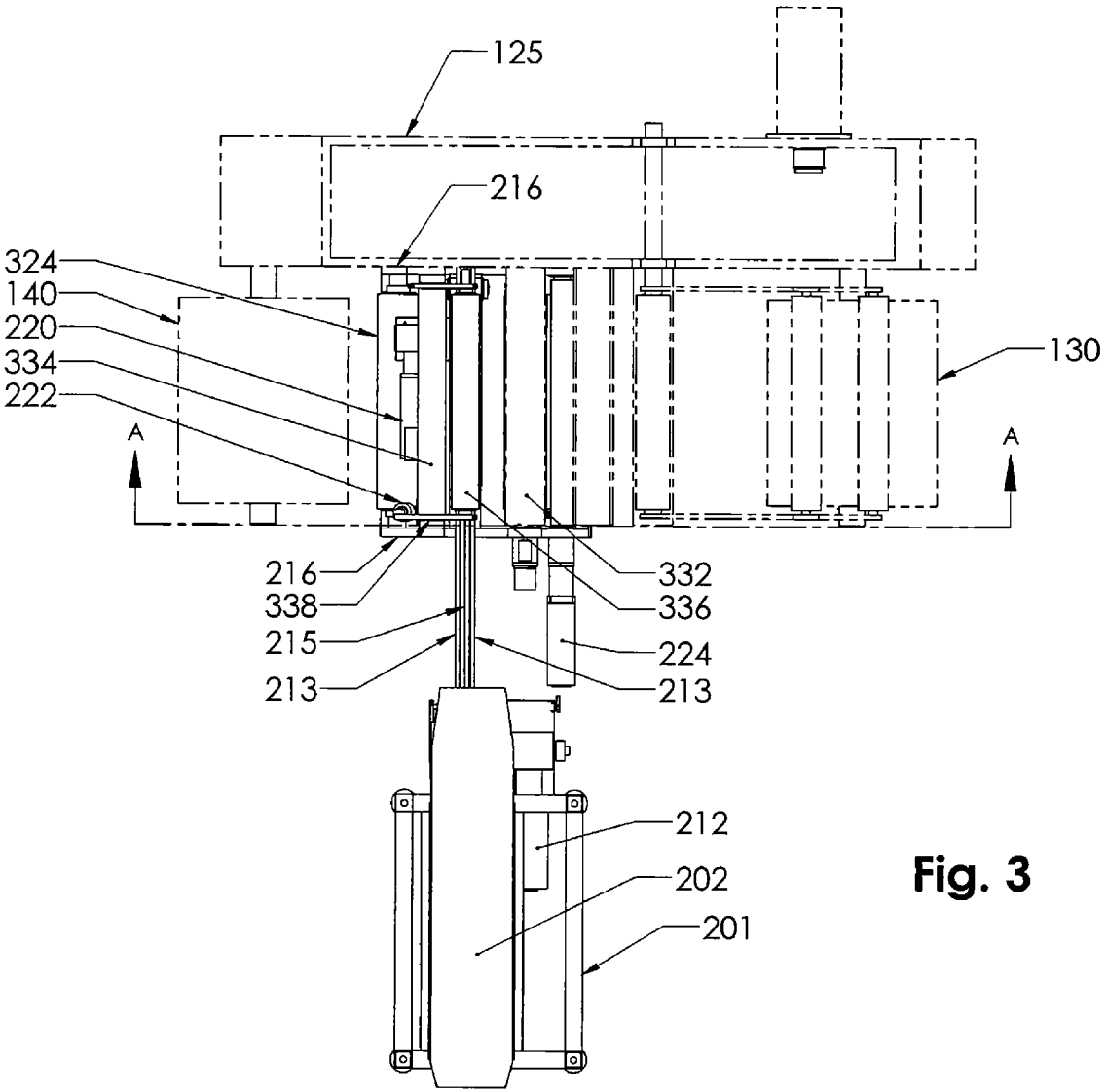
FIG. 3 is a top view of the system of FIG. 1.

Referring to FIGS. 1, 2, and 3, laser/tear tape unwind assembly 110 comprises frame 201, laser 202, laser beam 204 disposed over a beam focal length 206, tear tape 207, tear tape roll 208, tear tape roll spindle 209, tear tape rider roller 210, tear tape roll core expander 211, and tear tape roll servo drive 212. Tear tape applicator assembly 100 comprises vacuum belt frame member 213, v-guide rollers 214, vacuum belt 215, frame 216, vacuum belt servo drive 220, tamp roller cylinder 222, and a cross-notching servo drive 224.

Tear tape roll servo drive 212 is mounted to frame 201. Tear tape roll spindle 209 is pivotally connected to frame 201. Tear tape rider roller 210 is adjacent tear tape roll spindle 209. V-guide rollers 214 are rotatably connected to vacuum belt frame member 213. Vacuum belt 215 is disposed within vacuum belt frame member 213 and, in some embodiments, extends substantially co-extensively with frame member 213 from v-guide rollers 214 substantially horizontally in the direction of winder 120. Vacuum belt servo drive 220 is connected to frame member 213 and facilitates motion of vacuum belt 215 in the direction of winder 120. Frame 201 is positioned with respect to frame member 213 such that laser beam 204 issues from laser 202 over focal beam length 206 between laser 202 and frame member 213. In some embodiments, as illustrated in FIG. 1, laser 202 is positioned directly above and vertically aligned with frame member 213 such that laser beam 204 is directed toward the top of vacuum belt 215 disposed within frame member 213.

Figure 4:
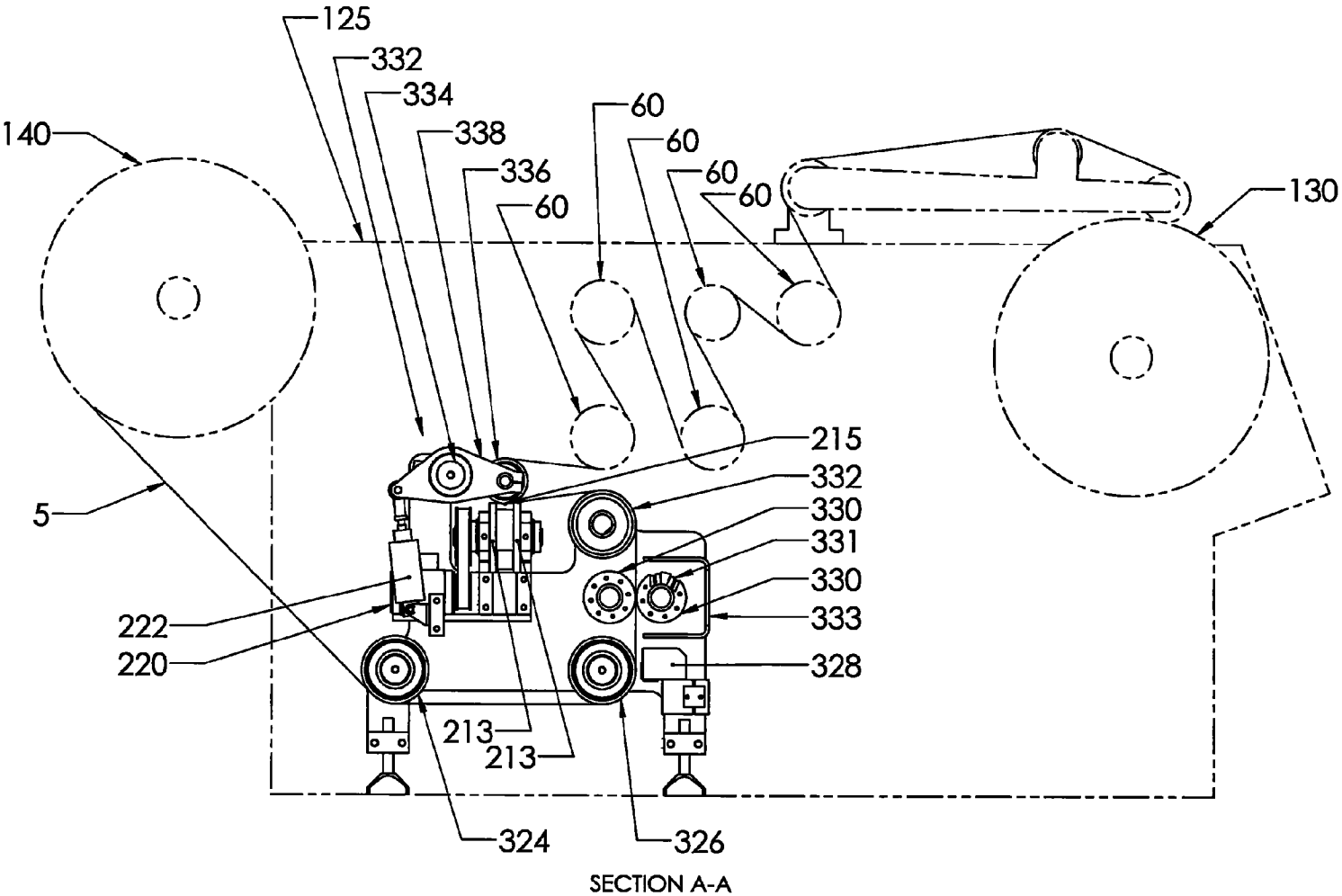
FIG. 4 is a cross-sectional view of FIG. 3, indicated by Section A-A on FIG. 3.

Referring to FIG. 4, tear tape applicator assembly 100 further comprises tamp roller assembly 322, idler rollers 324 and 326, registration eye 328, cross-notching cylinders 330 with cutting means 331, encoder roll 332, and knife guard 333. Tamp roller assembly 322 comprises torque tube 334, tamp roller 336, lever arm 338, and tamp roller cylinder 222. Cutting means 331 may be any suitable means for cutting or penetrating said web of packaging substrate 5, such as, by way of example and not of limitation, any one or more, or combination of one or more, of a perforator, a cutter, a cleaver, a clipper, an edge, a blade, a razor, a knife, a die, a punch, a laser, scissors, snips, perforating teeth, quick set perforating bars, etc. Tamp roller cylinder 222 may be any type of actuating cylinder, such as, for example, a pneumatic cylinder or a hydraulic cylinder.

Unwind roll 140, idler/dancer rolls 60 and wind-up roll 130 are rotatably and/or otherwise operably connected to base 125 of winder 120. Idler rollers 324 and 326, cross-notching cylinders 330, encoder roll 332, and tamp roller 336 are rotatably and/or otherwise operably connected to frame 216 of tear tape applicator assembly 100. For example, tamp roller 336 may be capable of rotational motion (e.g., rotation about an axis) and/or other periodic motion (e.g., periodic motion of a rotational axis), that is, the tamp roller may, for example, rotate and move up and down. Web of packaging material 5 extends substantially continuously along a web path defined by an unwind end and a rewind end. In some embodiments, web 5 extends substantially continuously from unwind roll 140, at the unwind end of the web path, to idler roller 324, to idler roller 326, past registration eye 328, to and between cross-notching cylinders 330, to encoder roll 332, to tamp roller 336, to idler/dancer rolls 60, and to rewind roll 130, at the rewind end of the web path. The winder 120 pulls web 5 through the machine via a rewind motor.

In a preferred embodiment, web 5 is unwound from unwind roll 140 and wound on rewind roll 130, as described above, at a substantially continuous speed as measured approximately at unwind roll 140 or rewind roll 130, or at approximately where tear tape applicator unit 10 cooperates with winder 120, for example, at approximately where tear tape 207 is applied to web 5. In some such embodiments, web 5 moves at about 220 feet per minute (ft./min.). The advancement of web 5 from unwind roll 140 to rewind roll 130 is said to be in a machine direction, as opposed to, e.g., a cross direction, and tear tape 207 is applied across the web 5 of ream wrap or other packaging material, i.e., in a cross direction. In a preferred embodiment, web 5 is not momentarily stopped during the application of tear tape 207 and instead moves substantially continuously.

Web 5 may be any type of packaging substrate, including, by way of example and not of limitation, paper, coated paper, solid plastic film, shrink wrap film, and paper/film combinations. The packaging substrate may comprise, without limitation, thermoplastic synthetic polymers, including polyolefins such as low density polyethylene, linear low density polyethylene, polypropylene coated with a layer of polyethylene, high density polyethylene, metallocene, electron-beam cured solid films, copolymers of ethylene and propylene and combinations of these polymers, polyesters, polyamides, polyvinyl polymers, and copolymers, and polylactic acid (PLA) resins. Preferred resins are polyethylene, low density, high density, or linear low density, and combinations thereof, as well as polypropylene coated or laminated with a layer of polyethylene, and polyesters. In a preferred embodiment, the substrate of web 5 provides a surface for printing or reverse-printing graphics and/or product labeling.

Referring again to FIGS. 1, 2, and 3, system 90 operates in the following manner. Tear tape roll 208 is supported by tear tape roll spindle 209 and is retained to tear tape roll spindle 209 by tear tape core expander 211. In a preferred embodiment, tear tape roll 208 is approximately ten (10) inches in diameter and approximately six (6) inches in width. Tear tape roll servo drive 212 facilitates unwinding of tear tape roll 208. As tear tape roll 208 unwinds, tear tape 207 extends from tear tape roll 208, around tear tape rider roller 210, to v-guide rollers 214. V-guide rollers 214 guide tear tape 207 onto vacuum belt 215 within vacuum belt frame member 213. Vacuum belt 215 facilitates movement of tear tape 207 in the direction of winder 120. As tear tape 207 passes under laser 202, laser beam 204, intermittently at predetermined time periods and/or measured sections of tear tape 207, cuts through tear tape 207. Laser 202 can be programmed to penetrate or cut tear tape 207 at any desired length. Preferably, laser 202 is programmed to cut tear tape 207 at predetermined lengths substantially equivalent to or slightly shorter than the width of web 5, i.e., tear tape 207 is cut to match the width of the ream wrapper or other packaging material web 5. Cut portions of tear tape 207 are advanced by vacuum belt 215 from laser beam 204 toward winder 120.

In some embodiments, tear tape 207 comprises a paper material, a polymeric material or film, or a paper/polymer combination which is coated with an adhesive or similar bonding material on one side. Tear tape 207 may comprise, for example: a coated strip of paper or film; a coated strip of high strength polymer film, such as polyethylene or polypropylene, with adhesive on one side of the strip; an identical material from which web 5 wrap itself is made. Tear tape 207 may be treated with an adhesive and/or any similar substance. In some embodiments, tear tape 207 is between about one-eighth (⅛)) of an inch to about three-quarters (¾) of an inch in width, with preferred embodiments being about one-eighth (⅛) of an inch to about one-quarter (¼) of an inch.

Referring to FIG. 4, web 5 is unwound from unwind roll 140 and guided by idler rollers 324 and 326. As web 5 passes registration eye 328, the registration eye 328 and the encoder roll 332 together measure properties of web 5, such as, for example, the speed at which web 5 is advancing, the location of certain marks or graphics on web 5, what length of web 5 has passed in a given time period, etc. The properties measured by registration eye 328 and the encoder roll 332 can be used to signal, by any suitable means, the operation of cross-notching servo drive 224 and cross-notching cylinders 330 such that web 5 is penetrated, cut, or notched in a certain predetermined pattern by cutting means 331 connected to cross-notching cylinders 330. The properties measured by registration eye 328 can also be used to signal, by any suitable means, the actuation of tear tape roll servo drive 212, vacuum belt servo drive 220 and/or tamp roller cylinder 222.

For example, in some embodiments, registration eye 328 and the encoder roll 332 can be programmed, via software means or otherwise, to measure a predetermined length of web 5 as web 5 passes. Said predetermined length may be measured by registration of certain repeating features of web 5, such as printed or reverse-printed characters, graphics, or other features, or by calculation as a function of time and/or the measured speed at which web 5 passes. When said predetermined length of web 5 passes, registration eye 328 along with the encoder roll 332 signals the operation of cross-notching servo drive 224 to cause cross-notching cylinders 330 to cut a notch or tab on an edge of web 5. Said notch or tab may be positioned at a location on the predetermined length of web 5 where tear tape 207 will be applied to web 5 further downstream in the system 90. In a preferred embodiment, cross-notching cylinders 330 are actuated to make about 150 cuts per minute (cuts/min.) as web 5 moves substantially continuously through system 90.

Knife guard 333 encloses cross-notching cylinders 330 to prevent unintentional access to cutting means 331 and other sharp and/or moving components.

After a section of web 5 passes through and is penetrated, cut, or notched by cross-notching cylinders 330, encoder roll 332 guides web 5 toward tamp roller 336. Web 5 passes between tamp roller 336 (e.g., above) and vacuum belt 215 and vacuum belt frame member 213 (e.g., below). As web 5 passes under tamp roller 336, cut portions of tear tape 207 are intermittently advanced by vacuum belt 215 in a direction substantially normal to web 5, i.e., in a cross direction, rather than in a direction of the motion of web 5, i.e., a machine direction. In a preferred embodiment, a cut portion of tear tape 207 is advanced by vacuum belt 215 under web 5, and once the cut portion of tear tape 207 is disposed substantially under web 5 in a cross direction—e.g., such that the ends of the cut portion of tear tape 207 are substantially aligned with and/or centered with respect to the edges of web 5—tamp roller cylinder 222 actuates lever arm 338 to pivot about torque tube 334 such that tamp roller 336 moves web 5 toward tear tape 207.

As facilitated by the motion of tamp roller 336, a cut portion of tear tape 207 is applied, adhered, and/or attached to web 5 by any suitable means. For example, in some embodiments, tear tape 207 is pre-treated with adhesive material on one side and tear tape 207 is attached to web 5 when tamp roller 336 pushes web 5 into tear tape 207.

After a cut portion of tear tape 207 is attached to web 5, web 5 is advanced through idler/dancer rolls 60 and wound on rewind roll 130.

In some embodiments, there could be several tear tape applicator units 10 interfacing with one (1) winder or rewinder 120. In such an embodiment, more than one tear tape can be applied to the web or packaging substrate at the same time. This would result in an increased speed of the tear tape applicator system 90.

Once tear tape 207 is applied to web 5 as described above, web 5 with attached tear tape 207 can be used as ream wrap or other packaging material for paper or other consumer goods. The web with attached tear tape may be used, for example, to package goods wherein the tear tape is on top of the ream wrap or other packaging material and, when the tear tape is pulled in its longitudinal (i.e., lengthwise) direction, the tear tape opens the top of the ream wrap or other packaging material, but keeps the integrity of the ream wrap or packaging material. Some embodiments of the ream wrap or other packaging material comprise a tear tape that does not completely remove a section of the ream wrap or package. Further, some embodiments of the ream wrap or other packaging material comprise a tear tape applied across the web so that it surrounds the entire width of the wrapped ream or package. When pulled, the tear tape opens one portion of the top or bottom end of the package. Thus, when pulled, the tear tape opens and enables the removal of one of the sealed ends of the ream wrap or other packaging material while leaving the remaining structure intact for storage and dispensing partial reams.

It is to be understood that the present invention is by no means limited only to the particular constructions herein disclosed and shown in the drawings. The appended claims should be construed broadly to cover any variations or modifications within the scope or range of equivalents of the claims.

We claim:

1. In a method for applying a cut portion of an adhesive tear tape to a web of a wrapper, which adapts the wrapper for tearing by the tear tape, including advancing the web in a machine direction, positioning the tear tape in alignment with a width of the web by a vacuum belt, cutting the tear tape with a cutting means to provide a cut portion while the tear tape is in alignment with the width of the web, and applying said cut portion to the web by a pressing device, the improvement comprising:

directing a laser beam toward a top of the vacuum belt and cutting the tear tape to provide said cut portion of the tear tape before the vacuum belt advances said cut portion of the tear tape in the cross direction and then positions said cut portion of the tear tape in alignment with the width of the web;

measuring a predetermined length of continuous movement of the web in the machine direction with a registration eye and an encoder roll; and signaling actuation of the pressing device in the form of a tamp roller to apply said cut portion of the tear tape to the web without stopping the web from said continuous movement in the machine direction.

2. In the method of claim 1, the improvement further comprising:

measuring a predetermined length of continuous movement of the web in the machine direction with the registration eye and the encoder roll; and signaling actuation of a vacuum belt servo drive of the vacuum belt for the vacuum belt to advance said cut portion in the cross direction.

3. In the system of claim 2, the improvement further comprising: the registration eye and the encoder roll measuring a predetermined length of continuous movement of the web in the machine direction, and signaling actuation of a cross-notching servo drive and cross-notching cylinders to cut a notch on an edge of the web.

4. In the method of claim 1, the improvement further comprising:

measuring a predetermined length of continuous movement of the web in the machine direction with the registration eye and the encoder roll; and signaling actuation of a cross-notching servo drive and cross-notching cylinders to cut a notch on an edge of the web.

5. In the method of claim 4, the improvement further comprising:

advancing the web in the machine direction with a winder.

6. In the method of claim 1, the improvement further comprising: advancing the web in the machine direction with a winder.

7. In the method of claim 2, the improvement further comprising: advancing the web in the machine direction with a winder.

* * * * *